United States Patent [19]

Nakaya et al.

[11] Patent Number: 4,697,757

[45] Date of Patent: Oct. 6, 1987

[54] SLEEVE TO BE ATTACHED TO THE REEL ON A WINDING OR REWINDING MACHINE

[75] Inventors: Tsutomu Nakaya, Kisarazushi; Masayoshi Maruyama, Kimitsushi, both of Japan

[73] Assignee: Okashiro Sangyo Kabushiki Kaisha, Fukuokashi, Japan

[21] Appl. No.: 837,959

[22] Filed: Mar. 10, 1986

[51] Int. Cl.[4] ..... B65H 75/02

[52] U.S. Cl. ..... 242/68.5; 242/78.1

[58] Field of Search ..... 242/68.5, 78.1, 118.32, 242/118.7, 118.8, 78.3; 277/227, 228; 428/473, 36, 478.2

[56] References Cited

U.S. PATENT DOCUMENTS

| | | | |
|---|---|---|---|
| 2,332,293 | 10/1943 | Blodgett | 242/78.1 |
| 2,911,327 | 11/1959 | Dudley | 277/227 X |
| 2,957,783 | 10/1960 | Dachs et al. | 428/473 |
| 3,039,907 | 6/1962 | Scholl | 428/473 X |
| 3,737,030 | 6/1973 | Stewart | 242/68.5 X |
| 3,940,081 | 2/1976 | Kubicki | 242/68.5 |
| 4,021,001 | 5/1977 | Sproat | 242/68.5 |
| 4,076,262 | 2/1978 | Deventer | 277/227 |
| 4,218,505 | 8/1980 | Shiga et al. | 428/473 X |
| 4,311,756 | 1/1982 | Brooksbank | 428/473 X |
| 4,350,309 | 9/1982 | Richard et al. | 242/68.5 X |

*Primary Examiner*—John M. Jillions

*Attorney, Agent, or Firm*—Oblon, Fisher, Spivak, McClelland, & Maier

[57] ABSTRACT

A sleeve to be attached to a reel on a steel strip winding or rewinding machine, which comprises a cylindrical, high-strength elastic resin layer and a leather layer which is adhered to the outer periphery of the resin layer.

9 Claims, 4 Drawing Figures

SLEEVE TO BE ATTACHED TO THE REEL ON A WINDING OR REWINDING MACHINE

BACKGROUND OF THE INVENTION

1. Field of the Invention

The present invention relates to a sleeve to be installed on the reel of a winding or rewinding machine to prevent the production of flaws in a steel strip while the steel strip is wound or rewound, after processing of the steel strip through hot rolling, cold rolling, surface treatment, etc.

2. Description of the Related Art

In the past, sleeves have been installed on the outer periphery of a reel to prevent the production of top flaws (step-type flaws) on the surface of the strip while the strip is wound on the reel of the winder. Top flaws are generated when the second turn of the strip is wound, and thereby stacked on the edge of the already wound strip. Such flaws become gradually smaller with an increasing number of wound layers, and eventually disappear.

Sleeves have also been installed to prevent the generation of slip flaws which are produced on the steel strip surface during winding or rewinding. These flaws result from a difference in linear velocity between the steel strip and the reel surface, or between layers of the steel strip.

Sleeves may be constructed of rubber alone or rubber embedded with synthetic resin at places. They may also be formed from a layer in contact with the steel strip, which is made of craft paper or synthetic resin. Some reels have a special configuration at the surface in contact with the steel strip. Other sleeves are made up of multi-layers.

When oil is applied to a steel strip, however, slip flaws may be produced in spite of the installation of the sleeve, because of the slippage occuring between the steel strip and the sleeve surface. Therefore, in such a case, the sleeve surface which is in contact with the reel and/or the surface of the steel strip must be washed well.

Alternatively, corrugated fiberboard, etc., may be inserted between the reel and the steel strip or between the sleeve and the steel strip to prevent the slippage. However, the prevention of slippage is not certain by this method, and a long time is required to attain the necessary tension for winding, and workability, profitability as well as safety have been poor in such cases.

In view of the above, it is evident that a need continues to exist for new types of sleeves which are capable of preventing flaws in steel strips during winding.

SUMMARY OF THE INVENTION

Accordingly, it is an object of the present invention to provide a means by which the production of slip flaws on steel strips during winding or rewinding from the winder may be reduced, and whereby the time required for obtaining the necessary tension for winding may be reduced.

In accordance with the present invention, the above object and other objects have been attained by providing a sleeve comprising a high strength elastic resin layer and a leather layer adhered to the resin layer, to be installed on the reel of the winding or rewinding machines.

DESCRIPTION OF THE PREFERRED EMBODIMENTS

Figure 1:
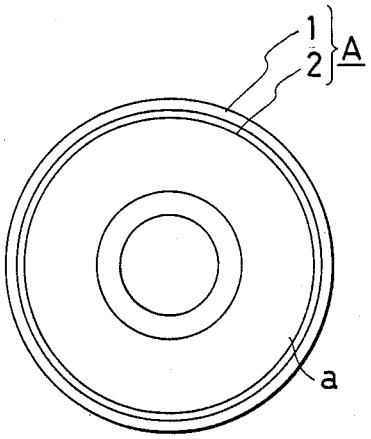
FIG. 1 is a side view of a sleeve according to this invention mounted on a reel, according to the first exemplary embodiment.

According to the first exemplary embodiment shown in FIG. 1, the structure of the sleeve A according to the present invention to be installed on the reel (a) of the winder or rewinder is explained as follows. Numeral 2 is a cylindrical elastic high strength resin. On the outer periphery of the elastic high strength resin layer 2 is adhered a leather layer (1).

In this embodiment, the resin layer is a stretched polyamide resin having the characteristics:

3,000 kgf/cm$^2$ or more of tensile strength, and 12,000 kdf/cm$^2$ or more of modulus of elasticity.

However, other polymeric resins such as a stretched polyester resin may also be used.

The leather layer 1 and high strength resin layer 2 may be glued directly together by an adhesive. Alternatively, a thin separate layer of another resin (such as another polyester or polyamide) or a thin cloth layer may be interposed between these two layers to improve the adhesive properties. Any adhesive capable of binding the layers together may be employed.

Figure 2:
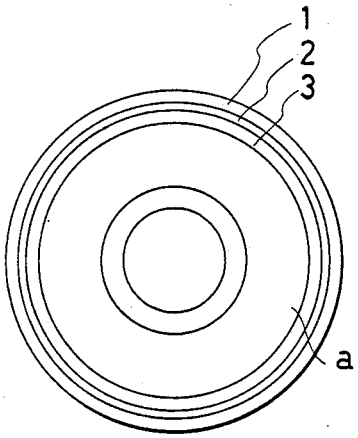
FIG. 2 is a side view of the second exemplary embodiment according to this invention.

Another leather layer 3 may further be adhered to the inside of the high strength resin layer 2, as shown in FIG. 2, which is the second exemplary embodiment of this invention.

Figure 3:
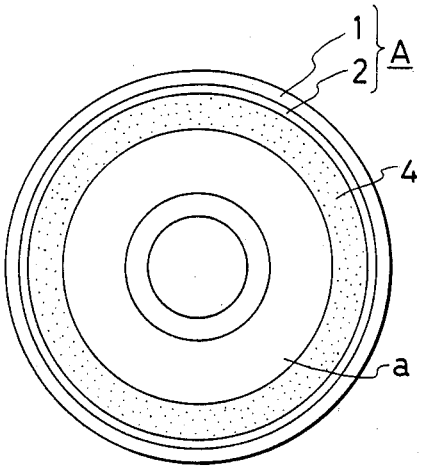
FIG. 3 is an end view of the third exemplary embodiment of this invention.

FIG. 3 shows yet another embodiment in which a conventional rubber sleeve 4 has been placed on the reel (a), and sleeve A (as in FIG. 1) has been duplicated on the outer circumference of the conventional rubber sleeve 4.

The leather materials useful in this invention may be natural or synthetic (leather-like) materials, such as those described in *Kirk-Othmer's Encyclopedia of Chemical Technology,* Volume 14, pages 200–249 (John Wiley and Sons, New York, 1981), which is hereby incorporated by reference. Preferred materials are natural cow or oxhide leathers. Additionally, it is within the scope of this invention that the leather materials may be treated with appropriate leather-treating agents, such as tanning agents.

The selection between putting a leather layer on the outside or the inside layer relative to the elastic high strength resin layer was determined in accordance with the experimental results shown in Table 1.

TABLE 1

| No. | Measure to Prevent Slip | Time required to attain the tension necessary to winding | Length of slip generated | Workability & Safety | General Appraisal |
|---|---|---|---|---|---|
| 1 | Clean steel reel | ca. 8 sec | ca. 4 m | Req. every time | Bad |
| 2 | Clean starting portion of winding steel strip | ca. 7 sec | ca 3.5 | Req. every time | Bad |
| 3 | CORRFBD is inserted between strip and rubber sleeve | ca. 7 sec | ca. 3.5 | Req. every time | Bad |
| 4 | Powder was applied to the surface of the rubber sleeve | ca. 7 sec | ca. 3.5 | Req. every time | Bad |
| 5 | Make surface of rubber sleeve smooth | ca. 7 sec | ca. 3.5 | | Bad |
| 6 | Make grooves on the surface of rubber sleeve | ca. 7 sec | ca. 3.5 | | Bad |
| 7 | Paste felt to the surface of rubber sleeve | ca. 7 sec | ca. 3.5 | Inferior in Durability | Bad |
| 8 | Paste duck (fabric) to the surface of rubber sleeve | ca. 7 sec | ca 3.5 | Inferior in Durability | Bad |
| 9 | Paste leather to the surface of rubber sleeve | ca. 3 sec | ca. 1.5 | Inferior in Durability | Bad |
| 10 | Insert cow or oxhide sleeve on steel reel | ca. 2 sec. | ca. 1.0 | Good | Good |
| 11 | Prepare cow or oxhide layer on the surface of Polyamide resin sleeve | ca. 2 sec | ca. 1.0 | Good | Best |
| 12 | Insert artificial leather sleeve on steel reel | ca. 2 sec | ca. 1.2 | Good | Good |
| 13 | Prepare artificial leather layer on the surface of rubber sleeve | ca. 2 sec | ca. 1.2 | Good | Good |

Abbreviation: CORRFBD - Corrugated fiber board; ca. = about

The time required to attain the required tension (4.0 kgf/mm$^2$) to the cold steel strip which has oil applied to the surface, and the length of the slip flaw which is produced at that time, were obtained experimentally. The workability and safety were also studied. The examples are characterized as follows:

1. The reel surface was cleaned,
2. The starting point of winding of the strip steel was also cleaned,
3. Corrugated fiber board was inserted between the steel strip and the rubber sleeve,
4. Powder was applied to the surface of the rubber sleeve,
5. and 6. The nature of the rubber sleeve surface was changed,
7. and 8. Other materials were adhered to the surface of the rubber sleeve,
9. A part of the surface of the rubber sleeve was pasted together with leather,
10. A cowhide or oxhide sleeve was installed on the surface of the steel reel,
11. A cowhide or oxhide layer was installed on the polyamide resin sleeve,
12. An artificial leather sleeve was inserted on the steel sleeve,
13. A layer of artificial leather was installed on the surface of a rubber sleeve.

Figure 4:
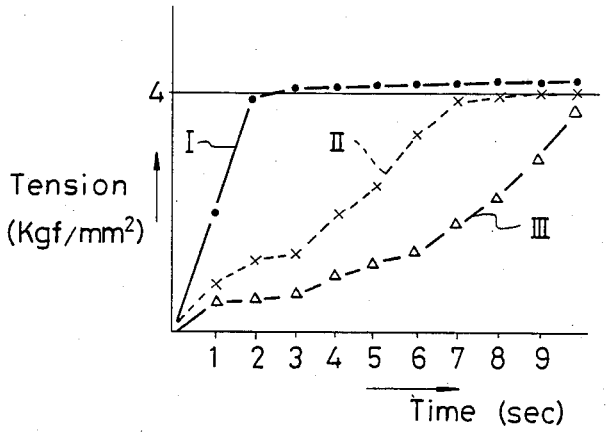
FIG. 4 is a graph showing a comparison between the sleeve of the present invention and a conventional sleeve.

In summary, the best results were obtained when the reel of the elastic high strength resin layer had a leather layer adhered thereto. The graph shown in FIG. 4 shows a comparison of the time required to attain the tension necessary for winding for the cases of: I. cowhide or oxhide layer adhered to the surface of the polyamide sleeve, II. corrugated fiber board inserted between the rubber sleeve and the steel strip, and III. the steel reel used as is. The graph also clearly indicates the superiority of the sleeve according to the present invention.

It is possible that the reduction of the slip flaw when a leather layer is contacted with the steel strip, is due to the substantially high frictional coefficient of leather (0.6–0.8), and even when oil is applied to the steel strip, the oil is absorbed into the leather layer, and therefore the reduction of the time required to obtain tension is due to the fact that slippage becomes difficult across the leather layer 1. This effect is also related to the existence of the elastic high strength resin layer 2 on the back face of the leather layer.

Due to the structure and function of the sleeve of the present invention, which makes slippage between the sleeve attached to the reel and the steel strip difficult, thereby reducing greatly the occurrence of slip flaws, work preparation can be performed in a short period of time. This is due to the reduction in time required to attain the necessary tension for winding. Accordingly, working efficiency can be greatly improved.

The invention now being fully described, it will be apparent to one of ordinary skill in the art that many changes and modifications can be made thereto without departing from the spirit or scope of the invention as set forth herein.

What is claimed as new and desired to be secured by Letters Patent of the United States is:

1. In a winding or rewinding machine, a rotatable reel element having a periphery, a sleeve member located on said periphery, said sleeve member comprising at least two layers, at least one of said layers comprising a high-strength elastic resin and an outermost of said layers being formed of leather.

2. The machine of claim 1, wherein said resin layer is made of a stretched polyamide resin.

3. The machine of claim 2, wherein said polyamide resin has a tensile strength of 3,000 $kgf/cm^2$ or more and a modulus of elasticity of 12,000 $kgf/cm^2$.

4. The machine of claim 1, wherein said resin layer is made of a stretched polyester resin.

5. The machine of claim 1, which has an inner resin layer and an outer leather layer, wherein said resin layer and said leather layer are adhered directly together.

6. The machine of claim 1, which has an inner resin layer and an outer leather layer, wherein said resin layer and said leather layer have interposed between them a separate layer of another resin or a thin cloth.

7. The machine of claim 1, wherein said leather layer is cow or oxhide leather.

8. The machine of claim 1, which has an inner leather layer, a resin layer, and an outermost leather layer.

9. The machine of claim 1, wherein said leather layer has a frictional coefficient of from about 0.6 to about 0.8.

* * * * *